US011752607B2

(12) United States Patent
Shen

(10) Patent No.: US 11,752,607 B2
(45) Date of Patent: Sep. 12, 2023

(54) DISCONNECT TONG

(71) Applicants: ZHUJI ITOP HARDWARE TOOLS CO., LTD., Zhuji (CN); ZHEJIANG IWISS ELECTRIC CO., LTD., Zhejiang (CN)

(72) Inventor: Yuejuan Shen, Zhuji (CN)

(73) Assignees: ZHUJI ITOP HARDWARE TOOLS CO., LTD., Shaoxing (CN); ZHEJIANG IWISS ELECTRIC CO., LTD., Leqing (CN)

( * ) Notice: Subject to any disclaimer, the term of this patent is extended or adjusted under 35 U.S.C. 154(b) by 0 days.

(21) Appl. No.: 17/398,520

(22) Filed: Aug. 10, 2021

(65) Prior Publication Data

US 2022/0212324 A1 Jul. 7, 2022

(30) Foreign Application Priority Data

Jan. 4, 2021 (CN) ..... 202120006878.1
Jan. 12, 2021 (CN) ..... 202120074755.1

(51) Int. Cl.
*B25B 27/14* (2006.01)
*B26B 17/00* (2006.01)

(52) U.S. Cl.
CPC ..... *B25B 27/14* (2013.01); *B26B 17/00* (2013.01)

(58) Field of Classification Search
CPC ... B25B 27/14; B25B 27/205; B25B 27/0035; B25B 27/005; B25B 27/0023; B25B 27/16; B25B 27/0021; B25B 27/28; B25B 27/30; B25B 27/302; B25B 27/306; B25B 5/067; B25B 5/101; B25B 9/00; B25B 9/02; B25B 33/00; B25B 7/18; B25B 7/06; B25B 7/02; B25B 7/00; Y10T 29/53613; Y10T 29/53622; Y10T 29/53678; Y10T 29/53683; Y10T 29/53848; Y10T 29/53852; Y10T 29/53909; Y10T 29/53874; B26B 17/00
USPC ..... 7/133; 81/485, 418–424
See application file for complete search history.

(56) References Cited

U.S. PATENT DOCUMENTS 1,051,633 A * 1/1913 Price ..... B25B 27/26 254/126
1,085,461 A * 1/1914 Michaelis ..... B25B 7/02 29/268
3,937,389 A * 2/1976 Wind ..... B65D 43/162 220/4.23
5,537,727 A * 7/1996 Mayer ..... F16L 37/0987 29/268
5,934,721 A * 8/1999 Walde ..... A47J 43/283 294/7

(Continued)

FOREIGN PATENT DOCUMENTS

WO WO-2020210029 A1 * 10/2020 ..... B25B 27/10

*Primary Examiner* — Hadi Shakeri
(74) *Attorney, Agent, or Firm* — Schwegman Lundberg & Woessner, P.A.

(57) ABSTRACT

A disconnect tong includes a disconnect tong body, a first clamping part and a second clamping part. The first clamping part is provided with at least two different first accommodating grooves. The second clamping part is provided with at least two different second accommodating grooves. An end of the first clamping part and an end of the second clamping part are both connected with the disconnect tong body, and a distance between the first clamping part and the second clamping part is variable.

19 Claims, 12 Drawing Sheets

(56) References Cited

U.S. PATENT DOCUMENTS

| | | | | |
|---|---|---|---|---|
| 8,307,745 | B2 * | 11/2012 | Christensen, III | B25B 7/12 81/485 |
| D965,142 | S * | 9/2022 | Clegg | D8/394 |
| 2012/0102728 | A1 * | 5/2012 | Xie | H01R 43/0425 29/761 |
| 2013/0093184 | A1 * | 4/2013 | Peirce | F16L 13/146 29/237 |
| 2015/0290778 | A1 * | 10/2015 | Burns | B25B 7/04 81/417 |
| 2017/0021474 | A1 * | 1/2017 | Gallagher | B25B 7/02 |
| 2019/0084129 | A1 * | 3/2019 | Buchanan | B25B 7/14 |
| 2019/0160632 | A1 * | 5/2019 | Chang | B25B 5/102 |

* cited by examiner

DISCONNECT TONG

CROSS-REFERENCE TO RELATED APPLICATIONS

This Non-provisional application claims priority under 35 U.S.C. § 119(a) to Chinese Patent Application No. 202120006878.1, filed on 4 Jan. 2021, and to Chinese Patent Application No. 202120074755.1, filed on 12 Jan. 2021, the entire contents of each of which are hereby incorporated by reference in their entirety.

TECHNICAL FIELD

The disclosure relates to the technical field of tools, in particular, to a disconnect tong.

BACKGROUND ART

Pipe fittings are used to connect pipes. General pipe fittings include elbows, tees, reducer, caps, various pipe joints, flanges, valves, expansion joints, pipe supports and so on. A connection between pipe fittings, between pipes, or between pipe fittings and pipes can be: a threaded connection, a flange connection, welding, a groove connection (clamp connection), a ferrule connection, a press fitting connection, a hot melting connection, a socket connection, an adhesive bonding, and the like.

A quick connect fitting is a fitting that can connect or disconnect pipelines without any tool. There are various quick connect fittings on the market, also known as push fittings. Such fittings have an advantage of saving a lot of time, and have less technical requirements for their use.

However, in an actual disconnecting process of the quick connect fitting, when a force between the fitting and the pipe is large, it is difficult to be disconnected. Furthermore, existing disconnecting tools for disconnecting the fittings can only be applied to a single-sized pipe diameter, and when pipelines and fittings with different sizes is required to be disconnected, disconnecting tools with different sizes are needed, which causes inconvenience to users and reduces working efficiency.

SUMMARY

In order to overcome at least one disadvantages of the prior art, the disclosure provides a disconnect tong which can be matched with pipe fittings with different sizes.

In order to achieve the above object, the disclosure provides a disconnect tong, which includes a disconnect tong body, a first clamping part and a second clamping part. The first clamping part is provided with at least two different first accommodating grooves. The second clamping part is provided with at least two different second accommodating grooves. An end of the first clamping part and an end of the second clamping part are both connected with the disconnect tong body, and a distance between the first clamping part and the second clamping part is variable. The first clamping part and the second clamping part cooperates with each other.

The first clamping part and the second clamping part of the disconnect tong of the disclosure are respectively provided with at least two different first accommodating grooves and second accommodating grooves, and the "different" here means difference in size or shape, and of course, also includes a case where both the size and shape are different. With at least two different first and second accommodating grooves provided, the disconnect tong can be applied to pipe fittings with different sizes without replacing a disconnecting tool, which is very convenient. When disconnecting connected objects A and B with the disconnect tong of this disclosure, the first accommodating groove catches the object A and the second accommodating groove catches the object B, and the end of the first clamping part and the end of the second clamping part are both connected with the disconnect tong body, and the distance between the first clamping part and the second clamping part is variable, so that the objects A and B at different positions can be separated or connected.

The object A and object B can be any one of an elbow, a tee, a reducer, a cap, various pipe joints, a flange, a valve, an expansion joint, a pipe support, a quick joint and a pipe.

In addition, the disconnect tong of this disclosure is especially suitable for disconnecting the quick joint. And the quick joint is provided with teeth, and when a reaction force is applied, the teeth will be deeply pressed into the pipe to prevent it from being separated from the pipe. The first accommodating groove or the second accommodating groove acts on a part of the quick joint which keeps the teeth in an open state, and correspondingly, the second accommodating groove or the first accommodating groove acts on other fittings, so that the quick joint and other fittings can be quickly and easily disconnected, realizing a quick disconnecting.

Optionally, the first accommodating groove and the second accommodating groove are arranged in pairs and are in one-to-one correspondence, particularly sizes and positions of the first accommodating groove and the second accommodating groove which are arranged in pairs are in one-to-one correspondence, so that the disconnect tong can be used in both positive and negative configurations. In another possible embodiment, the first accommodating groove and the second accommodating groove may be arranged in pairs, and the sizes and positions of the first accommodating groove and the second accommodating groove may not be in one-to-one correspondence, which is suitable for a case where sizes of the object A and the object B are different.

Optionally, there may be two, three, four, or any number of both the first accommodating grooves and the second accommodating grooves. A diameter of the first accommodating groove closer to the disconnect tong body is smaller, that is to say, a diameter of the first accommodating groove farther away from the disconnect tong body is larger, so as to ensure that a smallest pipe fitting or pipe can smoothly pass through the accommodating grooves on an upper side to reach an accommodating groove closest to the disconnect tong body. Furthermore, each of the first accommodating groove has a structure with a big top and a small bottom, which further ensures that a movement of the smallest pipe fitting or pipe is not hindered. Furthermore, a diameter of the first accommodating groove decreases from top to bottom.

Optionally, shapes of each first accommodating groove and each second accommodating groove are grooves with big tops and small bottoms, and in another possible embodiment, both the first accommodating groove and the second accommodating groove can also be square grooves, circular grooves, zigzag grooves or the like with big tops and small bottoms.

Optionally, all the first accommodating grooves are connected in sequence in an end-to-end fashion, and all the second accommodating grooves are connected in sequence in an end-to-end fashion.

Optionally, the disconnect tong body includes a first grip portion, a connecting portion and a second grip portion. Two ends of the first grip portion are respectively connected with an end of the connecting portion and an end of the first clamping part, two ends of the second grip portion are respectively connected with the other end of the connecting portion and the end of the second clamping part, and a distance between the first clamping part and the second clamping part is controlled by a displacement between the first grip portion and the second grip portion. Optionally, the first grip portion and the second grip portion are also symmetrically arranged, and lengths of the first grip portion and the second grip portion can be lengthened to increase a torque.

Optionally, the disconnect tong body further includes a fixing member, and two ends of the fixing member are respectively connected with the first grip portion and the second grip portion for adjusting and fixing the distance between the first grip portion and the second grip portion. In another possible embodiment, the fixing member may not be provided, that is, the disconnect tong body only includes a first grip portion, a U-shaped connecting portion and a second grip portion, and no fixing member is provided between the first grip portion and the second grip portion, and the first grip portion and the second grip portion are connected only by the connecting portion.

Optionally, the fixing member includes a threaded member and a first fixing block. A first end of the threaded member is threadedly connected to the first grip portion, a cavity for accommodating a second end of the threaded member is provided in the first fixing block, the first fixing block is arranged on the second grip portion, and the second grip portion is provided with a hole communicated with the cavity. After passing a wrench, a driver or a screwdriver through the hole on the second grip portion, the threaded member can be rotated to adjust and fix the distance between the first grip portion and the second grip portion.

Optionally, the fixing member further includes a second fixing block which is arranged on the first grip portion, a threaded hole is provided in the second fixing block, and the second end is threadedly connected in the threaded hole.

Optionally, the connecting portion is provided with a through hole which extends from an end of one of the grip portions to an end of the other one of the grip portions, thereby reducing difficulty of changing the distance between the first grip portion and the second grip portion.

Optionally, the disconnect tong body in this disclosure includes a left handle and a right handle hinged with each other, and the disconnect tong also includes a hinge member which is hinged with each other by the left handle and the right handle, and an end of the first clamping part is connected with the right handle through the hinge member, and an end of the second clamping part is connected with the left handle through the hinge member. The distance between the first clamping part and the second clamping part can be changed through a relative movement of the left handle and the right handle, which is more energy-saving as compared with a "U" shaped connecting component in the prior art.

Optionally, an end of the left handle is provided with a left connecting member, and an end of the right handle is provided with a right connecting member. The left connecting member and the right connecting member are connected with each other through a pivot on which a spring is sleeved.

Optionally, the left connecting member includes two oppositely arranged left nipper blades, two ends of which are respectively connected by fasteners; and the right connecting member includes two oppositely arranged right nipper blades, two ends of which are respectively connected by fasteners, and middle ends of the two left nipper blades are connected with middle ends of the two right nipper blades by the pivot.

Optionally, the hinge member includes a left hinge piece and a right hinge piece. An end of the left hinge piece is connected with the first clamping part, the other end of the left hinge piece is connected with one of two ends of the two left connecting members; an end of the right hinge piece is connected with the second clamping part, the other end of the right hinge piece is connected with one of two ends of the two right connecting members. The other one of two ends of the two left connecting members is connected with an end of the right hinge piece, and the other one of two ends of the two right connecting members is connected with an end of the left hinge piece.

Optionally, two left nipper blades and two right nipper blades are alternately arranged at two ends of the pivot.

Optionally, the left handle or the right handle further includes a paddle. An end of the paddle is fixed to one of the left nipper blades or the right nipper blades through a fastener, and the other end of the paddle is clamped with the right connecting member or the left connecting member.

To sum up, the first clamping part and the second clamping part of the disconnect tong provided in the disclosure are respectively provided with at least two different first accommodating grooves and second accommodating grooves, and the "different" here means difference in size or shape, and of course, also includes a case where both the size and shape are different. With at least two different first and second accommodating grooves provided, the disconnect tong can be applied to pipe fittings with different sizes without replacing a disconnecting tool, which is very convenient.

DETAILED DESCRIPTION

In order to make the above and other objects, features and advantages of the utility model more obvious and understandable, a detailed description is made below for the preferred embodiments with reference to the accompanying drawings.

In this disclosure, the "top" in an expression "big top and small bottom" refers to an end away from the disconnect tong body 30, and the "bottom" refers to an end close to the disconnect tong body 30.

An exterior in the disclosure refers to a direction of the disconnect tong close to use environment.

Embodiment 1

Now reference is made to FIG. 1 to FIG. 5. This embodiment provides a disconnect tong, which includes a disconnect tong body 30, a first clamping part 10 and a second clamping part 20. The first clamping part 10 is provided with three different first accommodating grooves. The second clamping part 20 is provided with three different second accommodating grooves. An end of the first clamping part 10 and an end of the second clamping part 20 are both connected with the disconnect tong body 30, and a distance between the first clamping part 10 and the second clamping part 20 is variable.

Figure 5:
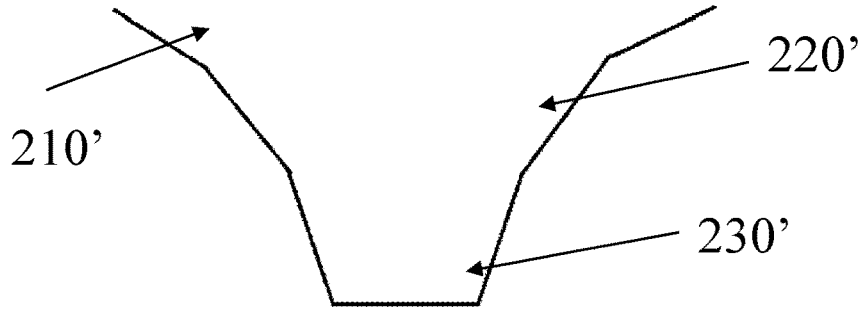
FIG. 5 is a schematic diagram of an accommodating groove with another shape of a disconnect tong provided in Embodiment 1 of the disclosure.
Figure 6:
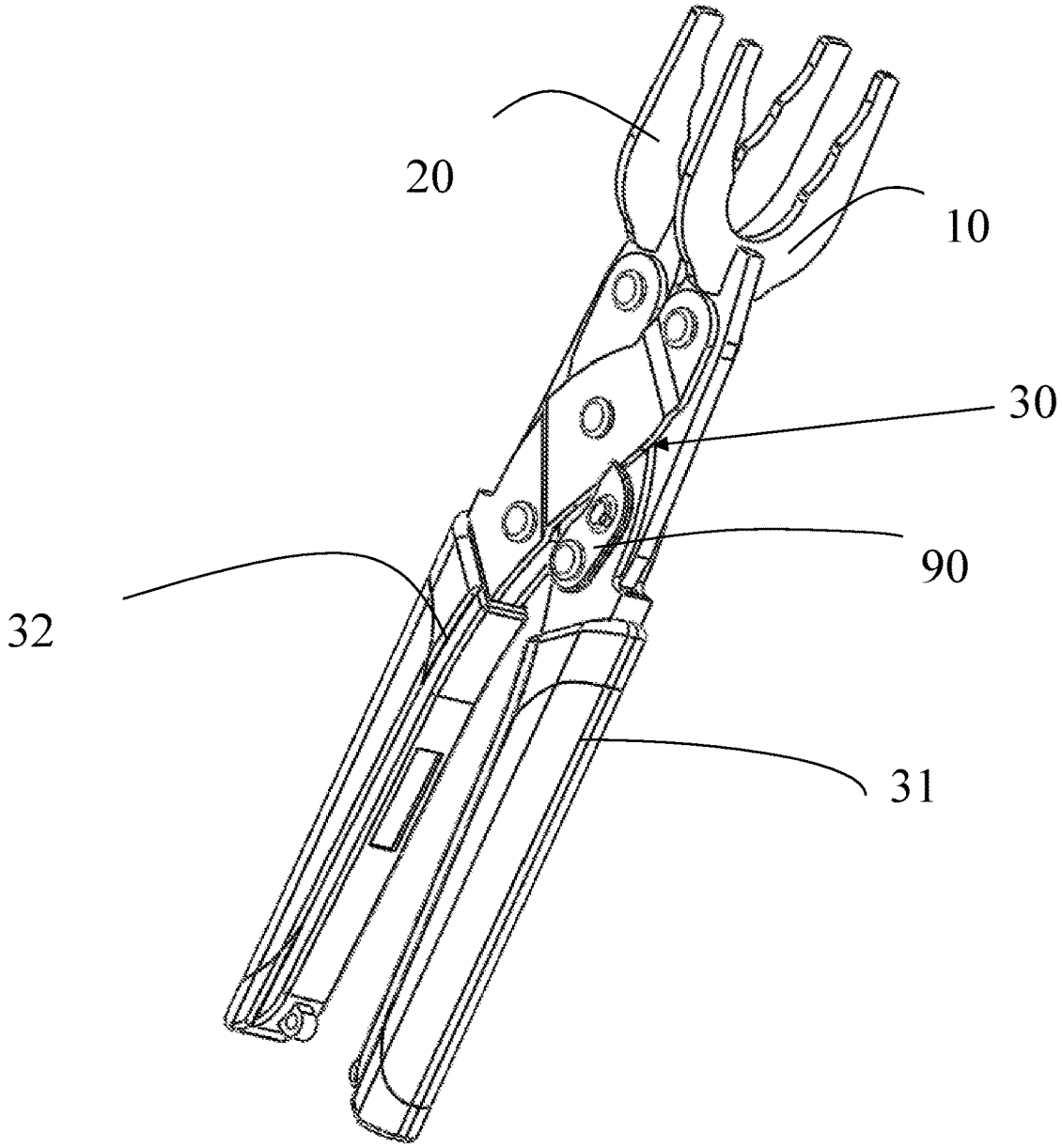
FIG. 6 is a schematic perspective view of a disconnect tong according to Embodiment 2 of the disclosure.

The first clamping part 10 and the second clamping part 20 of the disconnect tong of the disclosure are respectively provided with three different first accommodating grooves and three second accommodating grooves. In this embodiment, the expression "different" here means difference in size, which can be respectively set to be suitable for ⅛ inch pipe, ¼ inch pipe, and ⅜ inch pipe. The three first accommodating grooves and the three second accommodating grooves are all U-shaped grooves with big tops and small bottoms. As shown in FIG. 5, in another possible embodiment, both the first accommodating groove and the second accommodating groove can also be square grooves with big tops and small bottoms, and the three second accommodating grooves connected successively can be designated 210', 220' and 230' in turn. In other embodiments, both the first accommodating groove and the second accommodating groove can also be circular grooves or the like. With three different first and second accommodating grooves provided, the disconnect tong can be applied to pipe fittings with different sizes without replacing a disconnecting tool, which is very convenient.

The disconnect tong of this disclosure is especially suitable for disconnecting the quick joint. And the quick joint is provided with teeth, and when a reaction force is applied, the teeth will be deeply pressed into the pipe to prevent it from being separated from the pipe. The first accommodating groove or the second accommodating groove acts on a part of the quick joint which keeps the teeth in an open state, and correspondingly, the second accommodating groove or the first accommodating groove acts on other fittings, so that the quick joint and other fittings can be quickly and easily disconnected, realizing a quick disconnecting.

In this embodiment, an end of the first clamping part 10 and an end of the second clamping part 20 are both connected with the disconnect tong body 30, and the end of the first clamping part 10 and the end of the second clamping part 20 are connected with the disconnect tong body 30 through a bending section 40 bent inward. In other embodiments, an end of the first clamping part 10 and an end of the second clamping part 20 can be directly connected with the disconnect tong body 30. A connecting force is transmitted to the first clamping part 10 and the second clamping part 20 respectively through the disconnect tong body 30 so as to act on an object to be acted, and further, a distance between the first clamping part 10 and the second clamping part 20 is variable, and in this way, the first clamping part 10 and the second clamping part 20 can act on the object to be acted at different positions respectively by adjusting the distance between the first clamping part 10 and the second clamping part 20.

In this embodiment, both the first clamping part 10 and the second clamping part 20 have a sheet-like structure and are oppositely arranged, and each of the first clamping part 10 and the second clamping part 20 is provided with a groove with an opening facing away from a side of the disconnect tong body 30, and this groove is formed by respectively connecting three first accommodating grooves or three second accommodating grooves in an end-to-end fashion successively. The three first accommodating grooves and the three second accommodating grooves are arranged in three pairs, namely, the first accommodating groove and the second accommodating groove 230 which are closest to the disconnect tong body 30 are paired, the first accommodating groove and the second accommodating groove 210 which are furthest to the disconnect tong body 30 are paired, the first accommodating groove and the second accommodating groove 220 in middle are paired, and sizes and positions of each pair of first accommodating groove and second accommodating groove are in one-to-one correspondence, so that the disconnect tong can be used in both positive and negative configurations.

In this embodiment, a diameter of the first accommodating groove closer to the disconnect tong body 30 is smaller, that is to say, a diameter of the first accommodating groove farther away from the disconnect tong body 30 is larger, so as to ensure that a smallest pipe fitting or pipe can smoothly pass through the accommodating grooves on an upper side to reach an accommodating groove closest to the disconnect tong body 30. Furthermore, each of the first accommodating groove has a structure with a big top and a small bottom, which further ensures that a movement of the smallest pipe fitting or pipe is not hindered.

Figure 1:
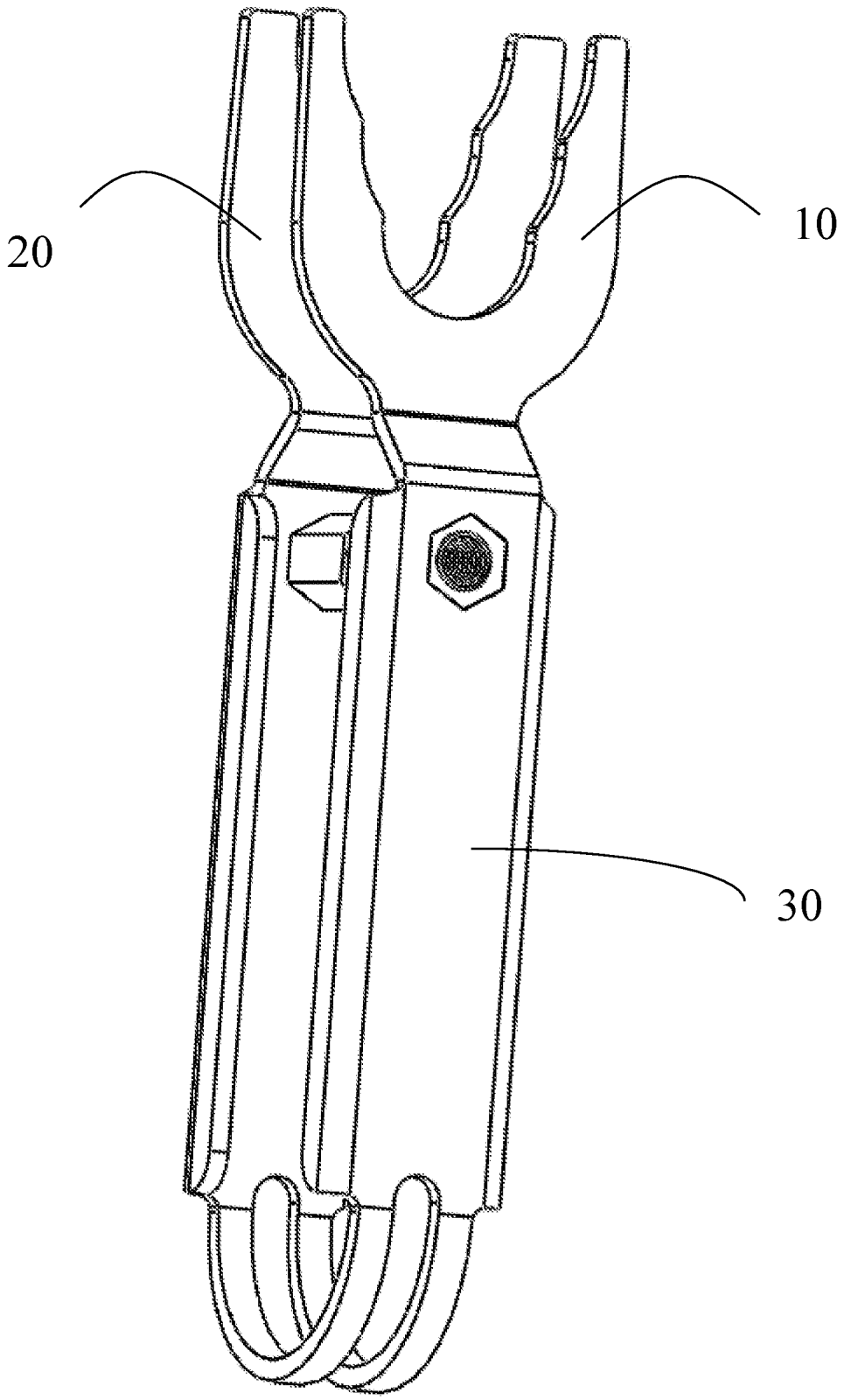
FIG. 1 is a schematic perspective view of a disconnect tong according to Embodiment 1 of the disclosure.
Figure 2:
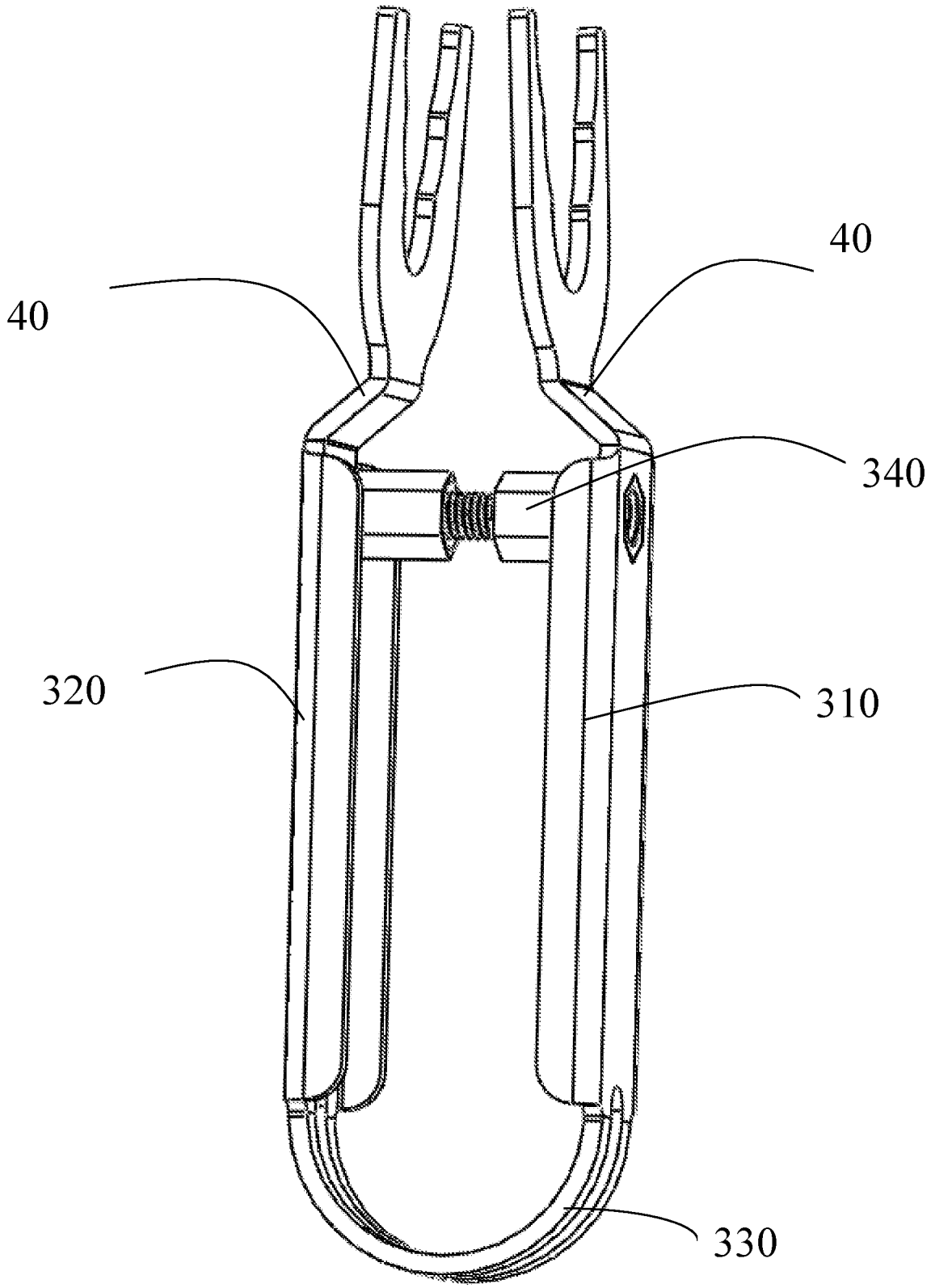
FIG. 2 is another schematic perspective view of a disconnect tong according to Embodiment 1 of the disclosure.
Figure 3:
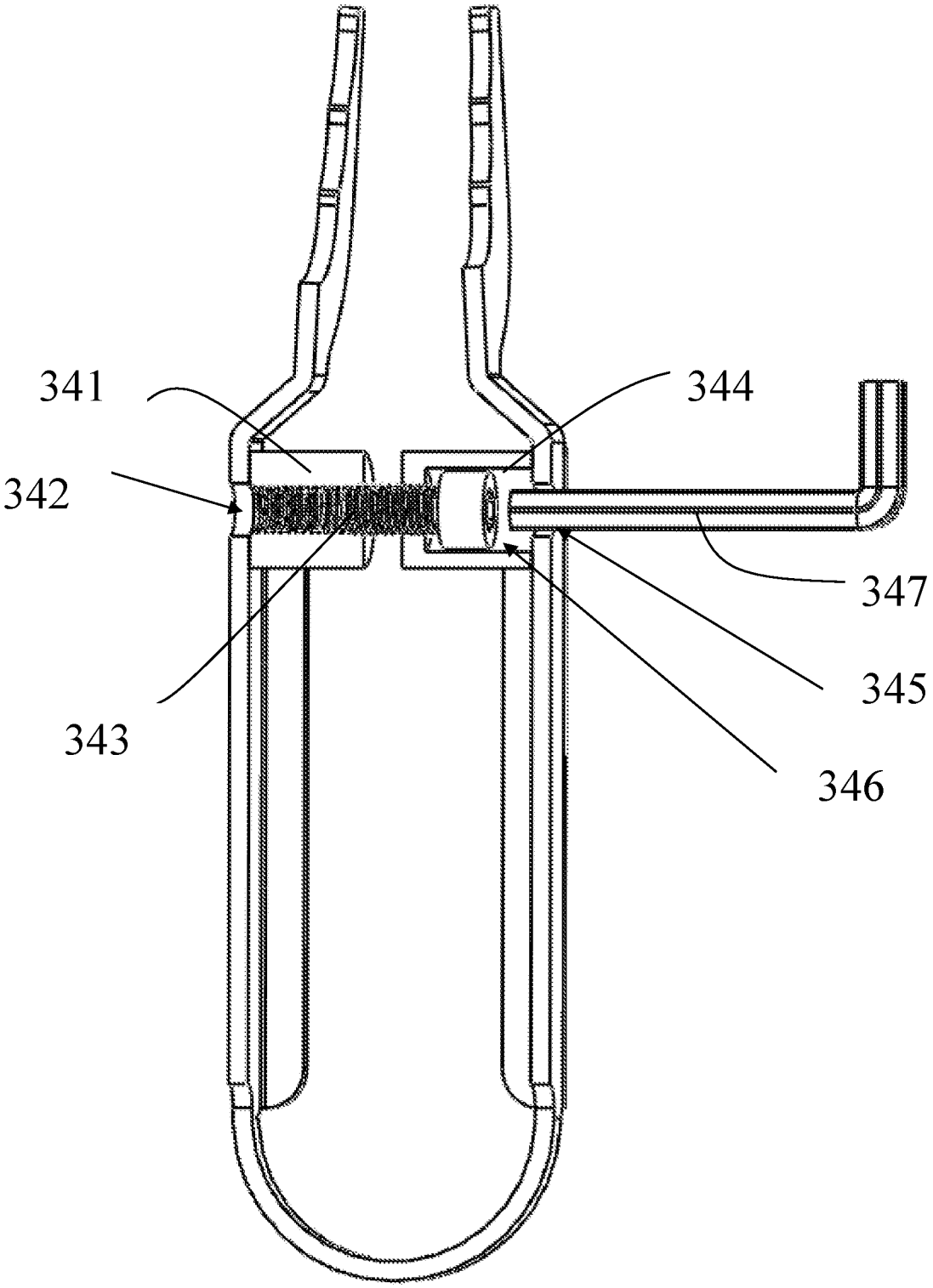
FIG. 3 is a schematic view of a disconnect tong in use with half thereof being cut away, according to Embodiment 1 of the disclosure.
Figure 4:
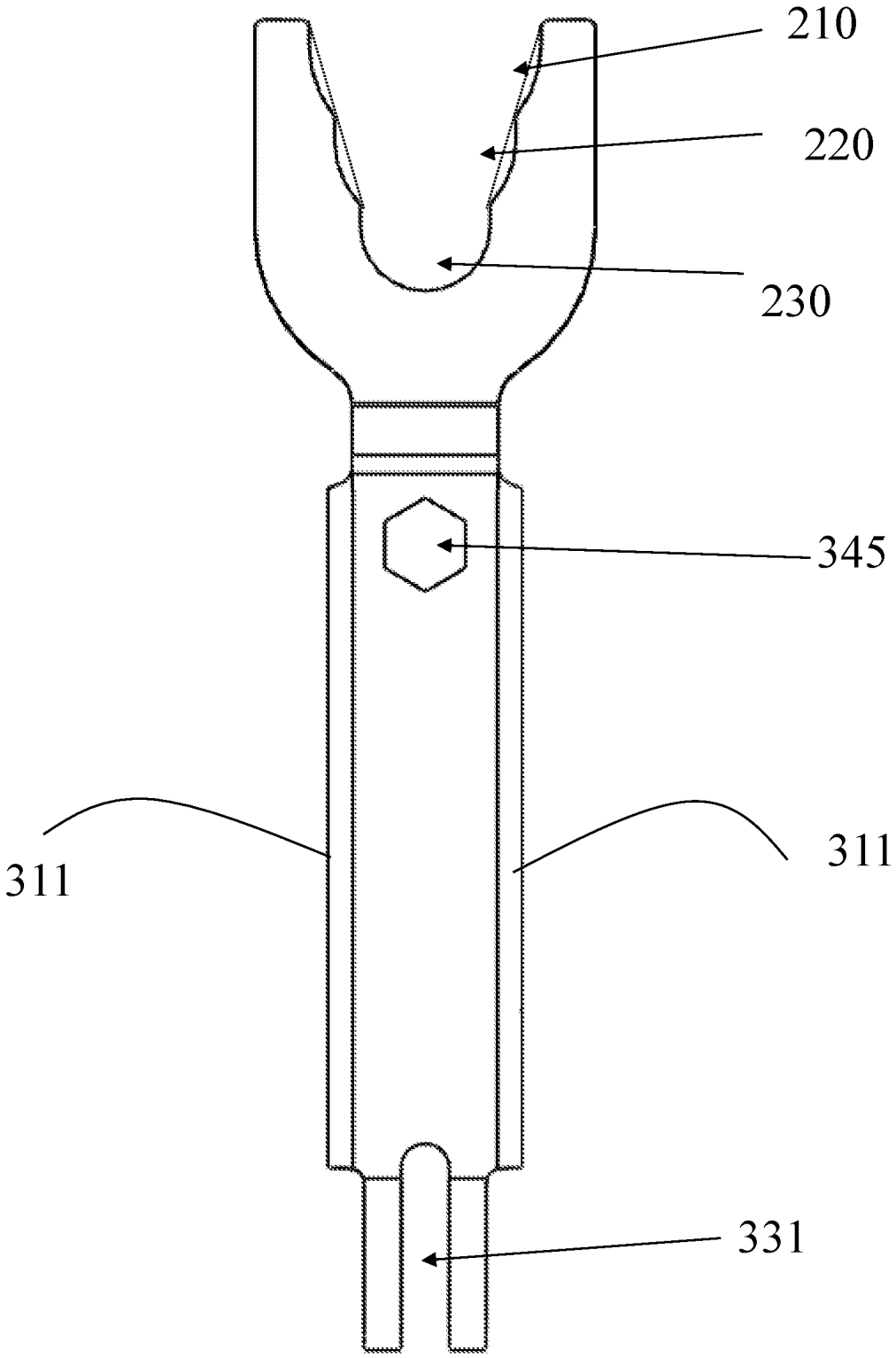
FIG. 4 is a side view of a disconnect tong according to Embodiment 1 of the disclosure.

In this embodiment, three first accommodating grooves can be made by cutting from a large U-shaped groove with a big top and a small bottom, and similarly, three second accommodating grooves can be made by cutting from a large U-shaped groove with a big top and a small bottom, and notches of the three first accommodating grooves are located on a same straight line in an axial section (see dashed line in FIG. 4).

In this embodiment, the disconnect tong body 30 includes a first grip portion 310, a connecting portion 330 and a second grip portion 320. Two ends of the first grip portion 310 are respectively connected with an end of the connecting portion 330 and an end of the first clamping part 10, two ends of the second grip portion 320 are respectively connected with the other end of the connecting portion 330 and an end of the second clamping part 20, and a distance between the first clamping part 10 and the second clamping part 20 is controlled by a displacement between the first grip portion 310 and the second grip portion 320. In this embodiment, the first grip portion 310 and the second grip portion 320 are also symmetrically arranged, and wings 311 are provided on both sides of the first grip portion 310 and the second grip portion 320 to increase gripping comfort. In other embodiments, the two sides of the first grip portion 310 and the second grip portion 320 can also be in a radiused transition design.

In this embodiment, the disconnect tong body 30 further includes a fixing member 340, and two ends of the fixing member 340 are respectively connected with the first grip portion 310 and the second grip portion 320 for adjusting and fixing the distance between the first grip portion 310 and the second grip portion 320. In other embodiments, in addition to the fixing member, a torque can be increased only by lengthening lengths of the first grip portion 310 and the second grip portion 320.

In this embodiment, the fixing member includes a threaded member 343 and a first fixing block 344. A first end of the threaded member 343 is threadedly connected to the first grip portion 310, a cavity 346 for accommodating a second end of the threaded member is provided in the first fixing block, the first fixing block is arranged on the second grip portion 320, and the second grip portion 320 is provided with a hole 345 communicated with the cavity. After passing a tool 347 such as a wrench, a driver or a screwdriver through the hole on the second grip portion 320, the second end of the threaded member is rotated, the first end and the first grip portion 310 rotate relatively, and a distance between the first grip portion 310 and the first fixing block is changed, thereby adjusting and fixing the distance between the first grip portion 310 and the second grip portion 320, thus fixing the distance between the first clamping part 10 and the second clamping part 20. A side of the first fixing block proximate the first grip portion is provided with a through hole communicated with the cavity to pass through the threaded member, and a size of the second end is larger than that of the through hole of the first fixing block, and further, a size of the second end is larger than that of the hole of the second grip portion 320. In other embodiments, the size of the second end may be equal to or smaller than the size of the through hole of the first fixing block, or may be equal to or smaller than the size of the hole of the second grip portion 320, with some other limiting structures limiting the second end from passing out of the cavity.

In this embodiment, the fixing member further includes a second fixing block 341 which is arranged on the first grip portion 310, and a threaded hole is provided in the second fixing block 341, and the second end of the threaded member is threadedly connected in the threaded hole 342.

In this embodiment, the connecting portion 330 is U-shaped, and the connecting portion 330 is provided with a through hole 331 which extends from an end of one of the grip portions to an end of the other one of the grip portions, two ends of the through hole is in a circular hole form, thereby reducing difficulty of changing the distance between the first grip portion 310 and the second grip portion 320.

In another embodiment, the connecting portion 330 may not be provided, that is, the threaded member 343, the first fixing block 344, the second fixing block 341, the threaded hole 342, the hole 345 communicating with the cavity, and the cavity 346 accommodating the second end of the threaded member may not be provided, and tools 347 such as wrenches, drivers or screwdrivers are not required.

Embodiment 2

Please refer to FIG. 6 to FIG. 14, the second embodiment provides another disconnect tong. The first clamping part 10 and the second clamping part 20 of Embodiment 2 are the same as those of Embodiment 1, and only the differences will be explained below.

The disconnect tong body includes a left handle 31 and a right handle 32 hinged with each other. An end of the first clamping part 10 is connected with the right handle 32 through the hinge member, and an end of the second clamping part 31 is connected with the left handle through the hinge member. The distance between the first clamping part and the second clamping part can be changed through a relative movement of the left handle 31 and the right handle 32. This is more energy-saving as compared with a "U" shaped connecting component in the prior art, but with a more complex structure.

In this embodiment, an end of the left handle 31 is provided with a left connecting member 301, and an end of the right handle 32 is provided with a right connecting member. The left connecting member and the right connecting member are connected with each other through a pivot 50 on which a spring 51 is sleeved, and the spring can function to reset. Shapes of the left jaw and the right jaw are consistent.

More specifically, the left connecting member 301 includes two oppositely arranged left nipper blades 312, two ends of which are respectively connected by fasteners 80; and the right connecting member includes two oppositely arranged right nipper blades 322, two ends of which are respectively connected by fasteners 60, and middle ends of the two left nipper blades 313 are connected with middle ends of the two right nipper blades 323 by pivots. The fasteners in this embodiment are all bolts. In other embodiments, they can also be studs, nuts, screws, etc. There are four fasteners in this embodiment.

Figure 7:
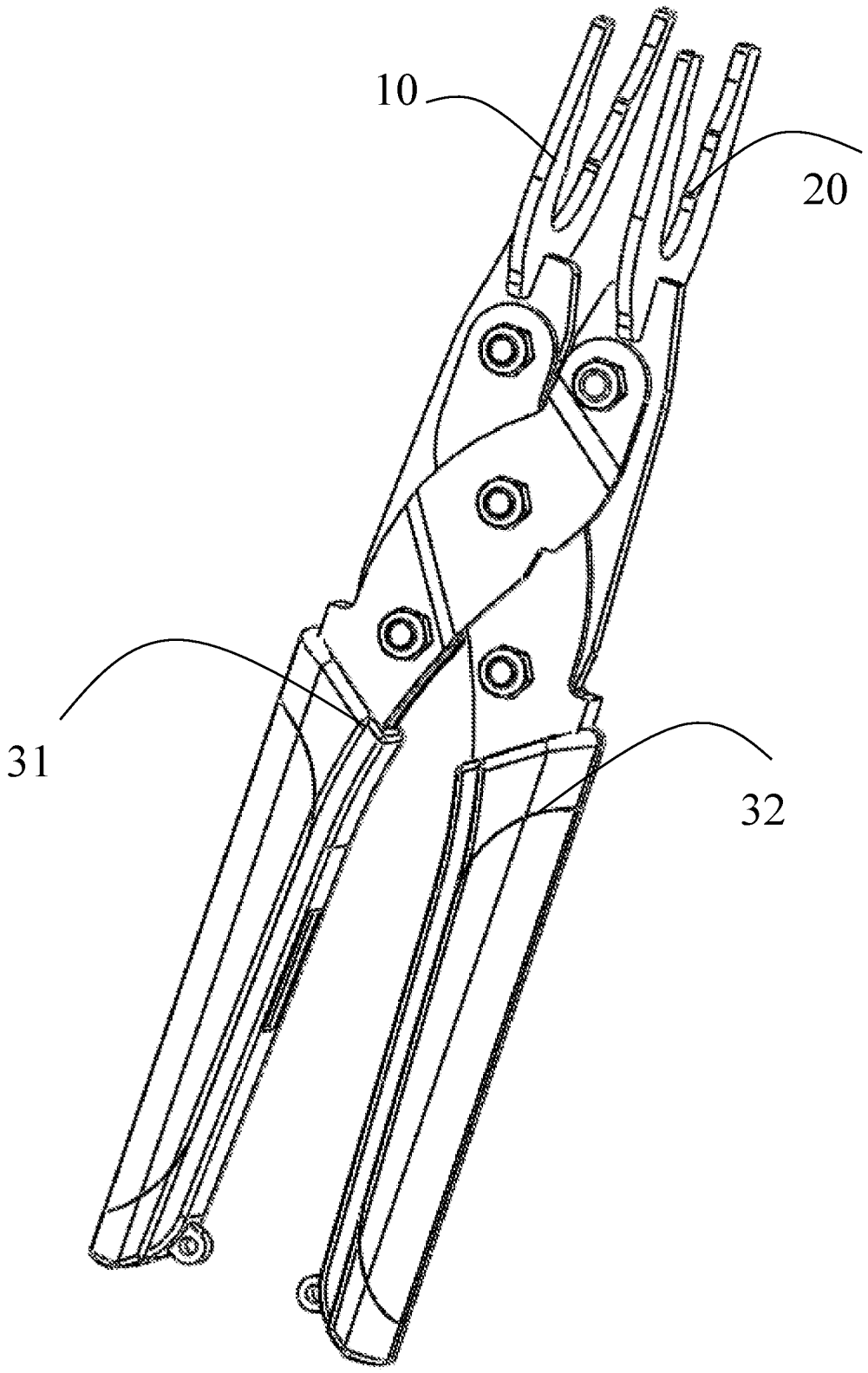
FIG. 7 is another schematic perspective view of a disconnect tong according to Embodiment 2 of the disclosure.
Figure 8:
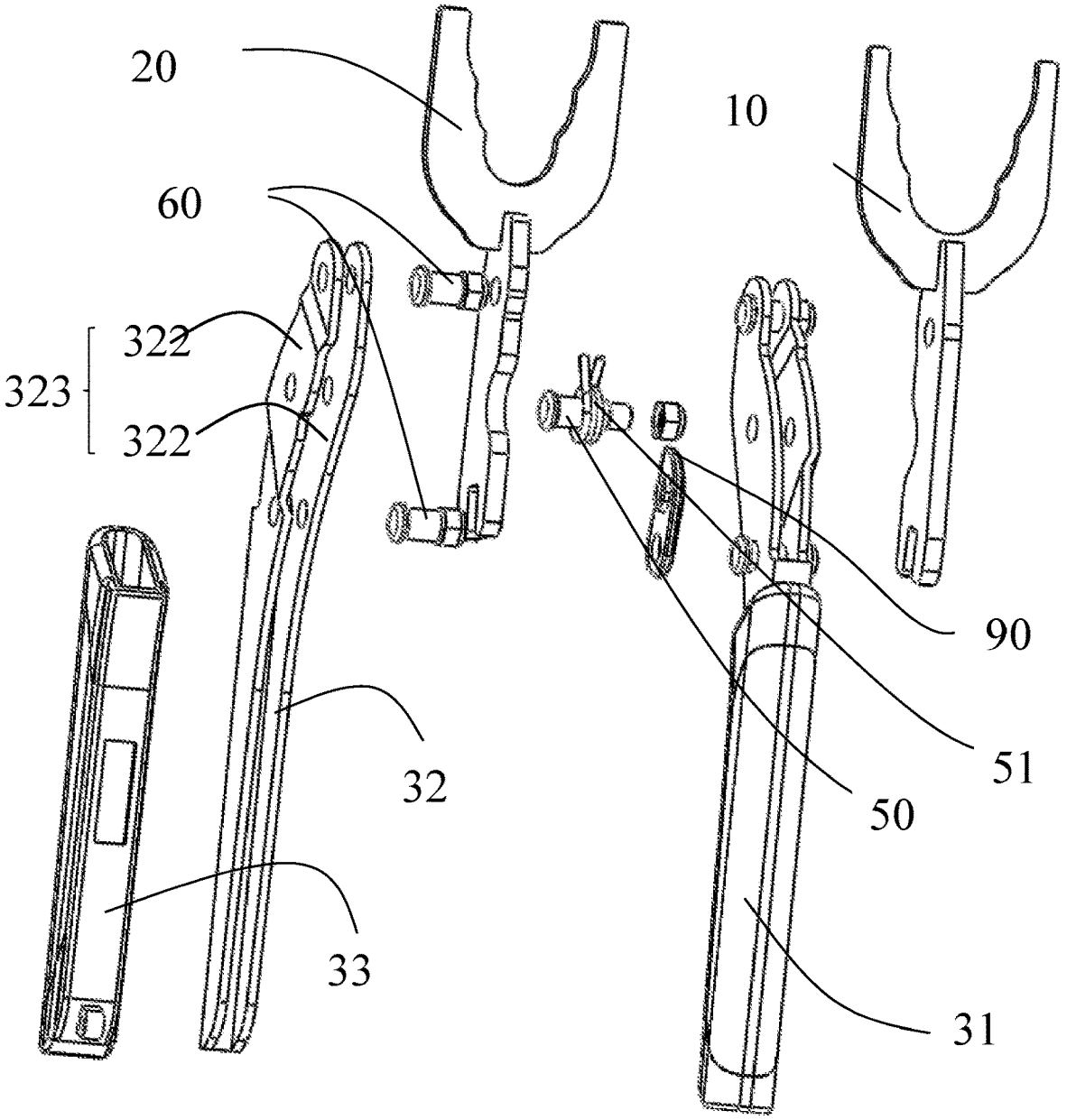
FIG. 8 is an exploded view of a disconnect tong according to Embodiment 2 of the disclosure.
Figure 9:
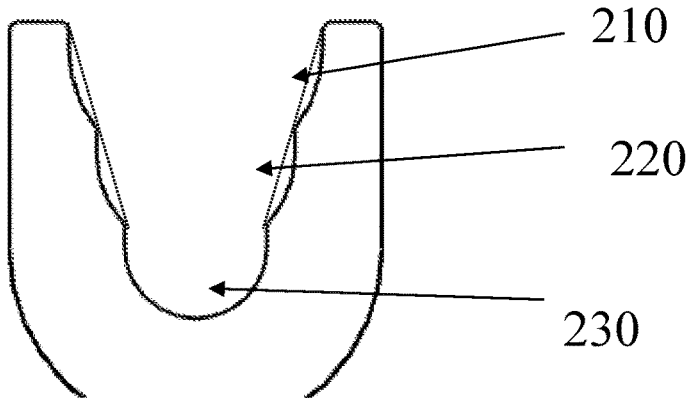
FIG. 9 is a side view of a jaw of a disconnect tong according to Embodiment 2 of the disclosure.
Figure 10:
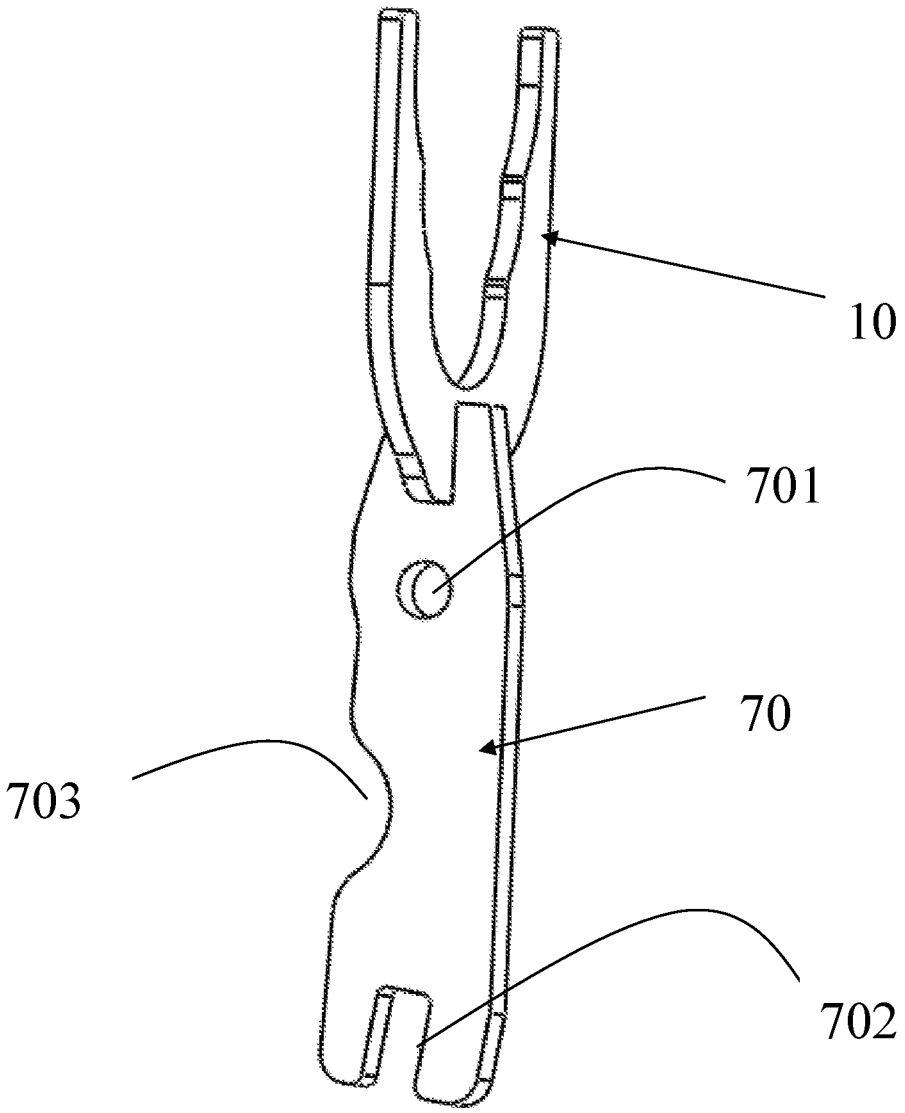
FIG. 10 is a schematic view of a combination of a right jaw and a right hinge piece of the disconnect tong according to Embodiment 2 of the disclosure.
Figure 11:
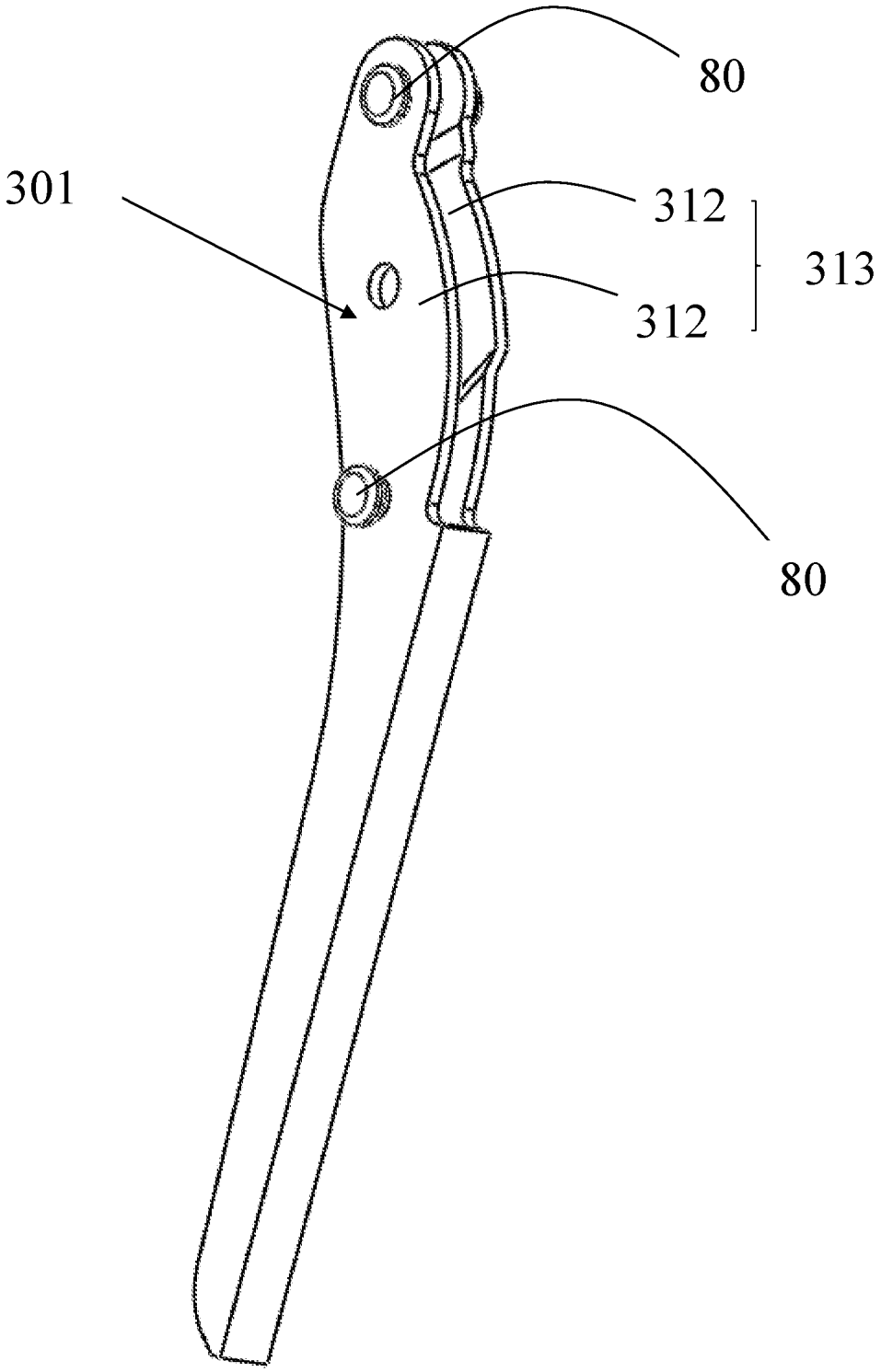
FIG. 11 is a schematic view of a right handle with its sleeve removed, according to Embodiment 2 of the disclosure.
Figure 12:
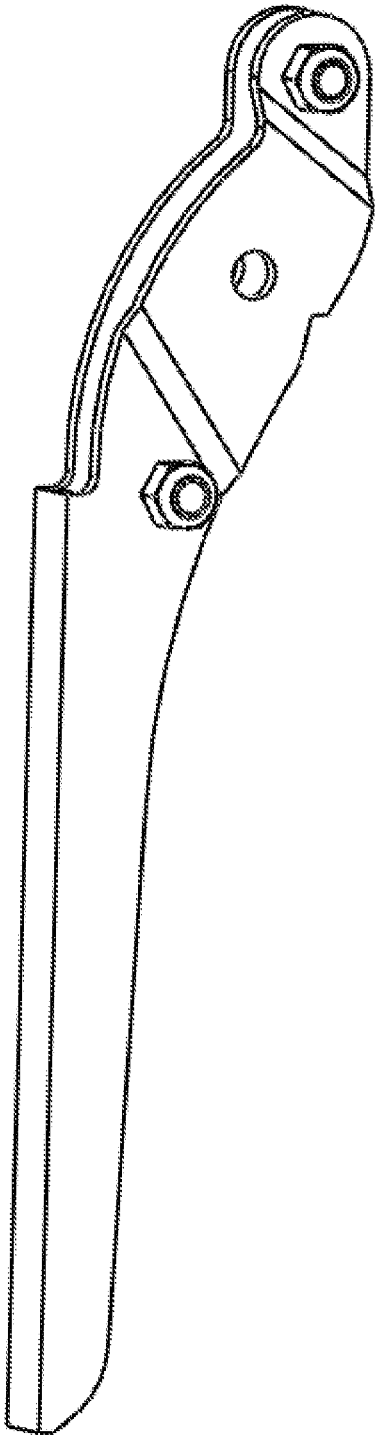
FIG. 12 is another schematic view of a right handle with its sleeve removed, according to Embodiment 2 of the disclosure.
Figure 13:
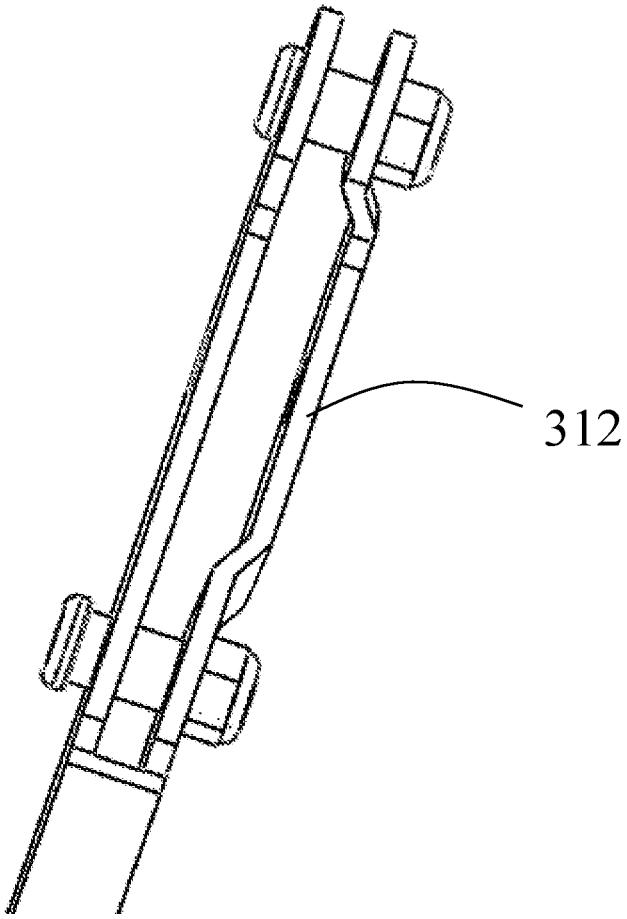
FIG. 13 is a side view of the right handle according to Embodiment 2 of the disclosure.
Figure 14:
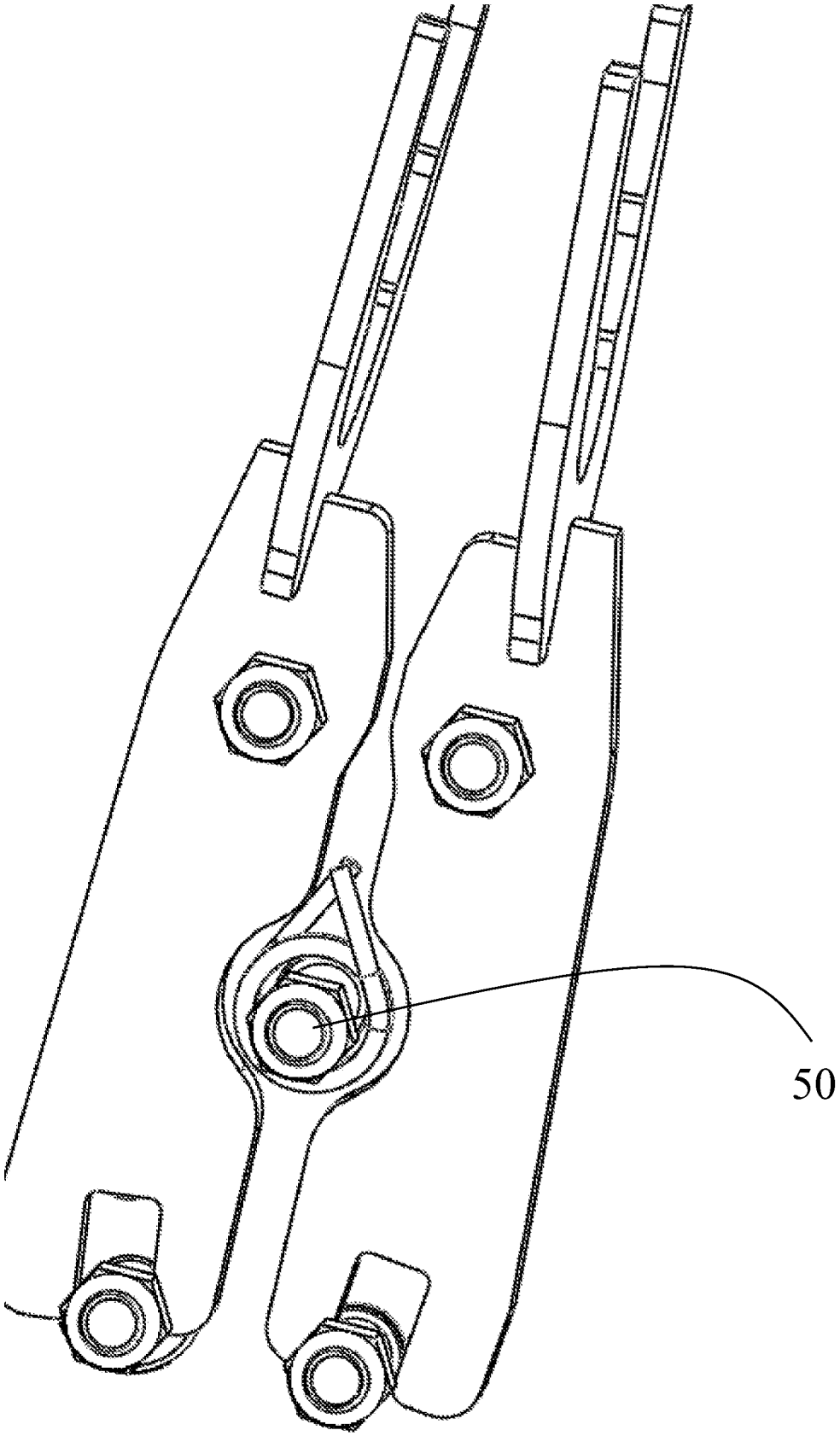
FIG. 14 is a schematic view showing a matching of the left hinge piece and the right hinge piece at a pivot according to Embodiment 2 of the disclosure.

The two left nipper blades may or may not be parallel to each other. In this embodiment, one of the left nipper blades is planar, and the other one of the left nipper blades protrudes outward, so does the right nipper blade, as shown in FIGS. 7 and 8.

In this embodiment, the hinge member includes a left hinge piece 70 and a right hinge piece. An end of the left hinge piece 70 is connected with the first clamping part, the other end of the left hinge piece is connected with one of two ends of the two left connecting members; an end of the right hinge piece is connected with the second clamping part, the other end of the right hinge piece is connected with one of two ends of the two right connecting members. The other one of two ends of the two left connecting members is connected with an end of the right hinge piece, and the other one of two ends of the two right connecting members is connected with an end of the left hinge piece. The left hinge piece and the right hinge piece are respectively oppositely provided with arc-shaped grooves 703 for accommodating the bolts. The other end of the left hinge piece and the other end of the right hinge piece are both provided with a groove 702 which has a square structure, and the square groove is used for accommodating the fasteners. Ends of the two left hinge pieces and the two right hinge pieces are provided with through holes 701 for the fasteners to pass through. The right hinge piece and the left hinge piece 70 have the same shape and size.

In this embodiment, two left nipper blades and two right nipper blades are alternately arranged at twos ends of the pivot. Here, the expression "alternately arranged" means that on one side of the disconnect tong, one of left nipper blades intersects with one of the right nipper blades, and on the other side of the disconnect tong, the other of left nipper blades intersects with the other of right nipper blades, which are all in an X-shaped arrangement. Furthermore, on one side of the disconnect tong, if the left nipper blade is arranged outside the right nipper blade, then on the other side of the disconnect tong, the right nipper blade is arranged outside the left nipper blade, so as to increase the firmness.

In this embodiment, the left handle 31 or the right handle 32 further includes a paddle 90. An end of the paddle is fixed to one of the left nipper blades or the right nipper blades through a fastener, and the other end of the paddle is clamped with the right connecting member or the left connecting member, and the paddle may be provided with a bump.

In this embodiment, the left handle 31 or the right handle 32 is sleeved with a handle sleeve 33, and in this embodiment the left handle 31 and the right handle 32 are symmetrical with each other.

It should be understood by those skilled in the art that in the disclosure of the utility model, the orientation or positional relationship indicated by the terms "upper", "lower", "front", "rear", "left", "right", "vertical", "horizontal", "top", "bottom", "inner" and "outer" or the like are based on the orientation or positional relationship shown in the drawings, which are only for convenience of describing the utility model and for simplifying the description, but do not indicate or imply that the indicated device or element must have a specific orientation, be constructed and operate in a specific orientation; therefore the above-mentioned terms cannot be understood as limitations to the utility model.

Although the utility model has been disclosed by the preferred embodiment in the above, it is not intended to limit the utility model and any person familiar with the art can make some changes and embellishments without departing from the spirit and scope of the utility model; therefore, the scope of protection of the utility model should be subject to the scope of protection as claimed in the claims.

What is claimed is:

1. A disconnect tong for disconnecting a quick joint and a tube, wherein the quick joint is provided with teeth deeply pressed into the tube, the disconnect tong comprising:

a disconnect tong body;

a first clamping part provided with at least three different first accommodating grooves; and a second clamping part cooperated with the first clamping part and provided with at least three different second accommodating grooves;

wherein an end of the first clamping part and an end of the second clamping part are both connected with the disconnect tong body, and a distance between the first clamping part and the second clamping part is variable;

wherein the first clamping part hinged with the second clamping part by the disconnect tong body;

wherein anyone of the least three different first accommodating grooves and anyone of the least three different second accommodating grooves are used to disconnect a quick joint and a tube;

wherein the first accommodating groove or the second accommodating groove acts on a part of the quick joint which keeps the teeth in an open state, and correspondingly, the second accommodating groove or the first accommodating groove acts on the tube or the quick joint, so that the quick joint and the fitting can be quickly and easily disconnected, thereby realizing a quick disconnecting;

wherein the at least three first accommodating grooves and the at least three second accommodating grooves are arranged in pairs, and sizes and positions of the first accommodating groove and the second accommodating groove which are arranged in pairs are in one-to-one correspondence;

wherein a size of a distal end of the first clamping part away from the disconnect tong body is different from a size of a distal end of the second clamping part away from the disconnect tong body.

2. The disconnect tong according to claim 1, wherein a diameter of the first accommodating groove closer to the disconnect tong body is smaller.

3. The disconnect tong according to claim 1, wherein all the first accommodating grooves are connected in sequence in an end-to-end fashion, and all the second. accommodating grooves are connected in sequence in an end-to-end fashion.

4. The disconnect tong according to claim 3, wherein each of the first accommodating grooves has a structure with a big top and a small bottom.

5. The disconnect tong according to claim 4, wherein the disconnect tong body comprises a first grip portion, a connecting portion and a second grip portion, two ends of the first grip portion are respectively connected with an end of the connecting portion and the end of the first clamping part, two ends of the second grip portion are respectively connected with the other end of the connecting portion and the end of the second clamping part.

6. The disconnect tong according to claim 4, wherein the disconnect tong body comprises a left handle and a right handle hinged with each other, and the disconnect tong body further comprises a hinge member, and an end of the second clamping part is connected with the left handle through the hinge member; the distance between the first clamping part and the second clamping part can be changed through a relative movement of the left handle and the right handle; an end of the left handle is provided with a left connecting member, and an end of the right handle is provided with a right connecting member, the hinge member comprises a pivot, the left connecting member and the right connecting member are connected with each other through the pivot on which a spring is sleeved.

7. The disconnect tong according to claim 1, wherein the disconnect tong body comprises a first grip portion, a connecting portion and a second grip portion, two ends of the first grip portion are respectively connected with an end of the connecting portion and the end of the first clamping part, two ends of the second grip portion are respectively connected with the other end of the connecting portion and the end of the second clamping part.

8. The disconnect tong according to claim 7, wherein the disconnect tong body further comprises a fixing member, and two ends of the fixing member are respectively connected with the first, grip portion and the second grip portion for adjusting and fixing the distance between the first grip portion and the second grip portion.

9. The disconnect tong according to claim 8, wherein the fixing member comprises a threaded member and a first fixing block, a first end of the threaded member is threadedly connected to the first grip portion, a cavity for accommodating a second end of the threaded member is provided in the first fixing block, the first fixing block is arranged at the second grip portion, and the second grip portion is provided with a hole communicated with the cavity, so that a tool rotates the second end of the threaded member after passing through the hole.

10. The disconnect tong according to claim 9, wherein a side of the first fixing block proximate the first grip portion is provided with a through hole communicated with the cavity to pass through the threaded member, and a size of the second end of the threaded member is larger than that of the through hole of the first fixing block.

11. The disconnect tong according to claim 10, wherein a size of the second end is larger than that of the hole of the second grip portion.

12. The disconnect tong according to claim 8, wherein the fixing member further comprises a second fixing block, the second fixing block is arranged at the first grip portion, a threaded hole is provided in the second fixing block, and the second end is threadedly connected in the threaded hole.

13. The disconnect tong according to claim 7, wherein the connecting portion is provided with a through hole which extends from an end of one of the grip portions to an end of the other the grip portion along the connecting portion.

14. The disconnect tong according to claim 1, wherein the disconnect tong body comprises a left handle and a right handle hinged with each other, and the disconnect tong body further comprises a hinge member, and an end of the second clamping part is connected with the left handle through the hinge member; the distance between the first clamping part and the second clamping part can be changed through a relative movement of the left handle and the right handle; an end of the left handle is provided with a left connecting member, and an end of the right handle is provided with a right connecting member, the hinge member comprises a pivot, the left connecting member and the right connecting member are connected with each other through the pivot on which a spring is sleeved.

15. The disconnect tong according to claim 14, wherein the left connecting member comprises two oppositely arranged left nipper blades, two ends of which are respectively connected by fasteners; and the right connecting member includes two oppositely arranged right nipper blades, two ends of which are respectively connected by fasteners, and middle ends of the two left nipper blades are connected with middle ends of the two right nipper blades by the pivot.

16. The disconnect tong according to claim 15, wherein the hinge member comprises a left hinge piece and a right hinge piece, wherein an end of the left hinge piece is connected with the first clamping part, the other end of the left hinge piece is connected with one of two ends of the two left connecting members; an end of the right hinge piece is connected with the second clamping part, the other end of the right hinge piece is connected with one of two ends of the two right connecting members; the other one of two ends of the two left connecting members is connected with an end of the right hinge piece, and the other one of two ends of the two right connecting members is connected with an end of the left hinge piece.

17. The disconnect tong according to claim 15, wherein the two left nipper blades and the two right nipper blades are alternately arranged at two ends of the pivot.

18. The disconnect tong according to claim 15, wherein the left handle or the right handle further comprises a paddle, an end of the paddle is fixed to one of the left nipper blades or the right nipper blades through a fastener, and the other end of the paddle is clamped with the right connecting member or the left connecting member.

19. The disconnect tong according to claim 1, wherein the at least three first accommodating grooves and the at least three second accommodating grooves are arranged in pairs, groove sidewalls of the paired first accommodating groove and second accommodating groove are all located on a same surface.

* * * * *